United States Patent [19]

Asselman et al.

[11] 4,258,554

[45] Mar. 31, 1981

[54] REFRIGERATOR

[75] Inventors: George A. A. Asselman; Adrianus J. van Mensvoort, both of Eindhoven, Netherlands

[73] Assignee: U.S. Philips Corporation, New York, N.Y.

[21] Appl. No.: 911,400

[22] Filed: Jun. 1, 1978

[30] Foreign Application Priority Data

Jun. 22, 1977 [NL] Netherlands ..... 7706880
Dec. 23, 1977 [NL] Netherlands ..... 7714306

[51] Int. Cl.[3] ..... F24B 7/00; G05D 23/00

[52] U.S. Cl. ..... 62/175; 62/333; 165/32; 165/96

[58] Field of Search ..... 62/175, 333; 165/96, 165/32

[56] References Cited

U.S. PATENT DOCUMENTS

| | | |
|---|---|---|
| 2,292,803 | 8/1942 | Steenstrup . |
| 2,314,190 | 3/1943 | Atchison . |
| 2,350,348 | 6/1944 | Gaugler . |
| 2,492,648 | 10/1945 | McCloy . |
| 2,581,044 | 1/1952 | Ratcliff . |

*Primary Examiner*—William E. Wayner

*Attorney, Agent, or Firm*—Thomas A. Briody; William J. Streeter; Rolf E. Schneider

[57] ABSTRACT

A refrigerator comprising a freezing compartment and a refrigerating compartment which refrigerator is provided with a primary refrigerating system containing a refrigerant with a primary evaporator disposed in the freezing compartment, and a secondary refrigerating system which also contains a refrigerant with a secondary evaporator disposed in the refrigerating compartment, and a secondary condensor which is in heat-exchanging contact with the primary evaporator, which condensor has a condensation wall on whose surface the refrigerant condenses during operation, means being provided for varying the available condensation wall area, so as to control the temperature of the secondary evaporator. Preferably, the secondary condensor is provided with a reservoir containing a control gas, which during operation constitutes an interface with the refrigerant vapor at the location of the condensation wall, the interface being movable along the condensation wall with the aid of a reversible control gas getter, which can be heated and which is located in the reservoir, which getter enables the amount of free control gas to be varied. The reversible control-gas getter can be heated by means of an electric heating element which is included in an electrical control circuit.

7 Claims, 11 Drawing Figures

REFRIGERATOR

The invention relates to a refrigerator having a freezing compartment and a refrigerating compartment, which refrigerator is provided with a primary refrigerating system which contains a refrigerant with a primary evaporator disposed in the freezing compartment, and a secondary refrigerating system which also contains a refrigerant with a secondary evaporator disposed in the refrigerating compartment and a secondary condensor which is in heat-exchanging contact with the primary evaporator, which secondary condensor has a condensation wall on whose surface the refrigerant condenses during operation.

A refrigerator of the said type is known from German Patent No. 1,601,010.

A problem associated with such two-temperature refrigerators is presented by control of the temperature in the refrigerating compartment independently of the temperature in the freezing compartment.

From German Pat. No. 1,601,010 it is known to provide the secondary refrigerating system with a heating device with, independently of the primary refrigerating system, enables liquid refrigerant to be evaporated, so that the amount of refrigerant available for the secondary evaporator, and hence the temperature in the refrigerating compartment, is controllable. However, a major drawback of such a control system is that the heating device delivers comparatively much heat to the secondary refrigerator, which heat is to be dissipated by the primary refrigeration system.

This has a highly unfavourable effect on the thermal efficiency of the installation.

It is an object of the invention to provide a better solution for the temperature control of the refrigerating compartment. The refrigerator in accordance with the invention is therefore characterized in that the secondary condensor is provided with means for varying the available condensation wall area so as to control the temperature of the secondary evaporator.

When the wall area of the secondary condensor available for condensation is varied, the amount of refrigerant which condensates, and thus the temperature of the secondary evaporator, will vary. It is now in particular possible to adapt the available condensation wall area in such a way that, when the temperature in the freezing compartment changes, for example for rapidly freezing food, the temperature in the refrigerating compartment remains constant. Moreover, it is possible to defrost the secondary evaporator by adjusting the available condensation wall area of the secondary condensor to a minimum.

A preferred embodiment of the refrigerator in accordance with the invention is characterized in that the secondary condensor is provided with a reservoir containing a control gas, which control gas during operation constitutes an interface with refrigerant vapour at the location of the condensation wall, the interface being movable along the condensation wall. Owing to the movable interface the wall surface available for condensation can be adjusted to a size which corresponds to a desired temperature in the refrigerating compartment.

A further preferred embodiment of the refrigerator in accordance with the invention is characterized in that the reservoir containing the control gas contains a reversible control-gas getter, which can be heated for varying the amount of free control gas. Depending on its temperature this control-gas getter may absorb control gas or release control gas, so that the amount of free control gas can be reduced or increased respectively. The displacement of the interface by which this is attended causes an increase or decrease of the available condensation wall area.

A further preferred embodiment of the refrigerator in accordance with the invention is characterized in that the reversible control gas getter can be heated by means of an electric heating element which is included in an electrical control circuit, which control circuit includes a temperature-sensitive element which is mounted in the refrigerating compartment, which temperature-sensitive element controls the heating element so as to maintain a specific temperature level in the refrigerating compartment.

Preferably, the reversible control-gas getter and the electric heating element are accommodated in a holder of a thermal insulating material, which holder is provided with at least one wall which is permeable to a control gas.

Preferably, the refrigerant is a freon, the control gas is nitrogen, and the reversible control-gas getter is constituted by a molecular filter material, such as a zeolite.

A different embodiment of the refrigerator in accordance with the invention is characterized in that the reservoir has a fixed partition, which divides the reservoir into two sections, which is permeable to control gas and not to refrigerant vapour.

The advantage of this embodiment is that the temperature of the secondary evaporator can be controlled without the use of auxiliary energy.

Still another embodiment of the refrigerator in accordance with the invention is characterized in that the reservoir containing the control gas comprises a movable bounding wall for moving the interface. Owing to the movable bounding wall the interface between control gas and refrigerant vapour can be adjusted via the control gas to a position which corresponds to a specific size of the available condensation wall area, which in its turn corresponds to a desired temperature in the refrigerating compartment.

A further suitable embodiment of the refrigerator in accordance with the invention is characterized in that the movable bounding wall, with its side which is remote from the reservoir containing the control gas, forms part of the bounding surface of a further reservoir, which contains a pressure-transfer medium whose pressure is controllable.

In accordance with the invention the pressure-transfer medium can be heated by means of an electric heating element which is included in an electrical control circuit, which control circuit comprises a temperature-sensitive element which is disposed in the refrigerating compartment, which temperature-sensitive element controls the heating element so as to maintain a specific temperature level in the refrigerating compartment.

A further suitable embodiment of the refrigerator in accordance with the invention is characterized in that the secondary condensor takes the form of a tapered tube whose cross-section increases towards the secondary evaporator. Owing to a larger cross-section at the inlet side of the condensor tube the rate of evaporation upon entrance in the secondary condensor is low. This facilitates reflux of condensed refrigerant to the secondary evaporator. Moreover, a part of the condensor tube has a smaller volume, so that in the case of control actions via this section the control speed is high.

When the refrigerating compartment is disposed above the freezing compartment, a construction, which employs the force of gravity for reflux of the refrigerant which has condensed in the secondary condensor to the secondary evaporator, may present problems. This problem can be solved in accordance with the invention by connecting the secondary condensor to the secondary evaporator via a capillary structure. Feedback of condensed refrigerant to the secondary evaporator is now effected by capillary action independently of the force of gravity.

Still an other embodiment of the refrigerator in accordance with the invention is characterized in that the secondary evaporator is locally provided with pockets which serve as reservoir for liquid refrigerant. This embodiment has the advantage that it results in a uniformly distributed evaporation of the liquid over the entire evaporator surface. As a result of this cooling times for the refrigerating compartment are short, for example, after a defrosting period.

The invention will now be described in more detail with reference to the drawing which shows some embodiments schematically and not to scale.

FIG. 1 schematically represents the two refrigerating systems in a refrigerator in which the freezing compartment is disposed above the refrigerating compartment, FIG. 2 shows an electrical control circuit for a refrigerator in accordance with FIG. 1.

Figure 1:
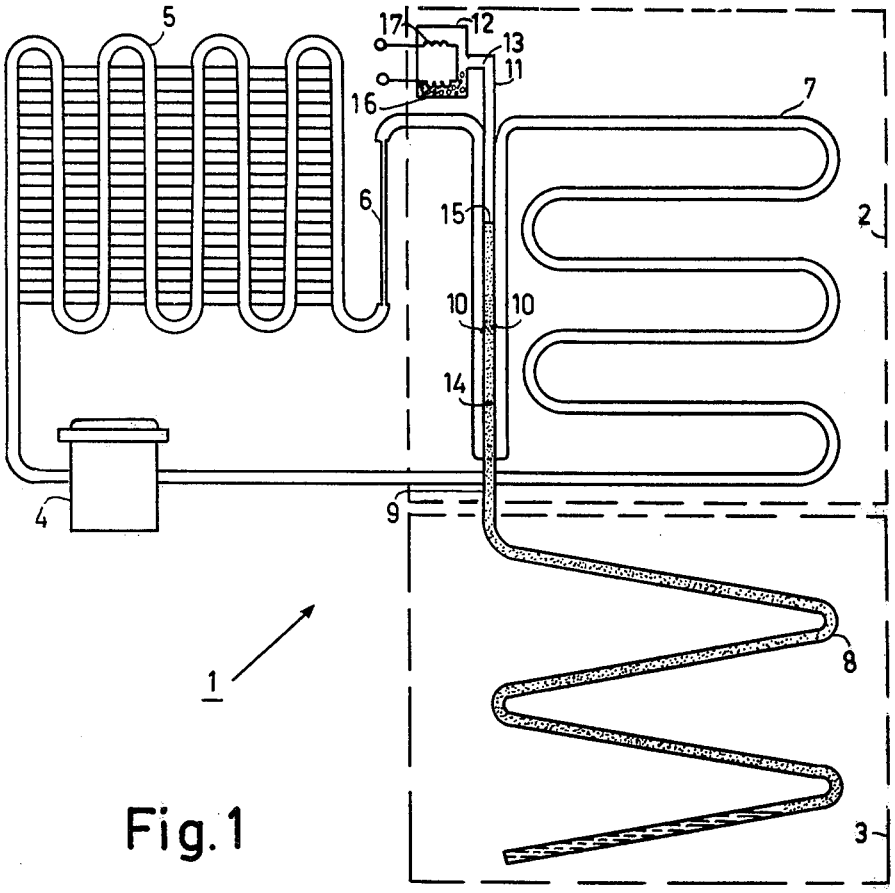
Figure 6:
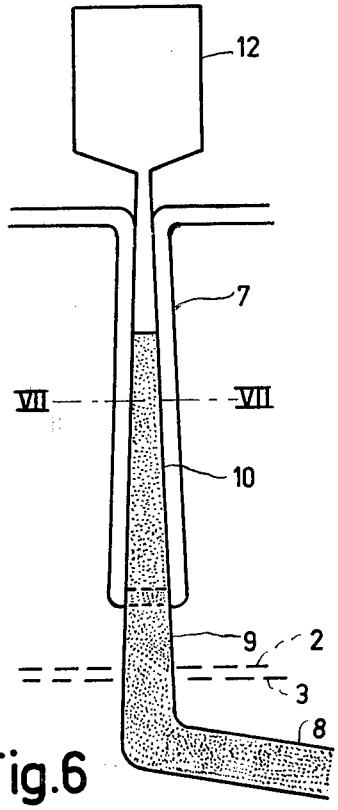
Figure 7:
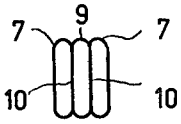
Figure 8:
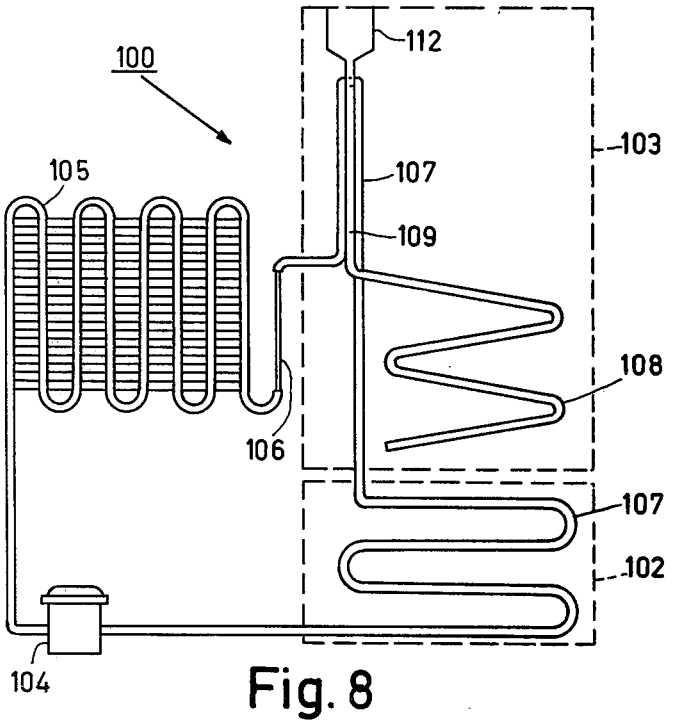
Figure 9:
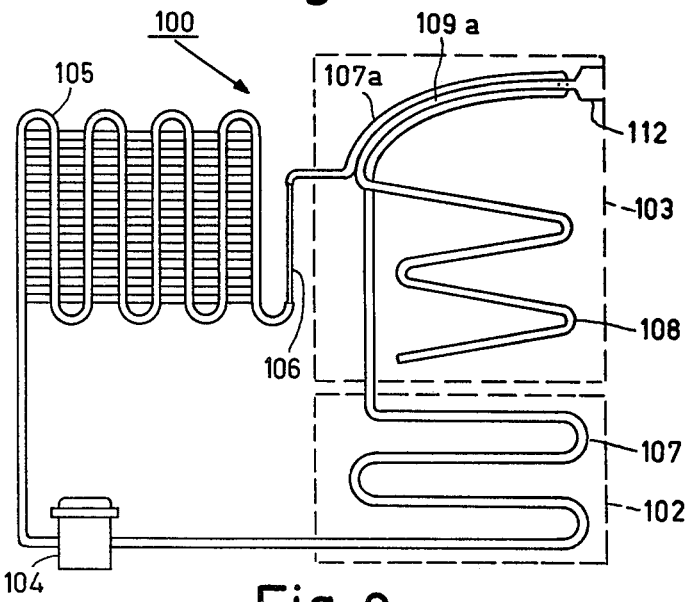
Figure 10:
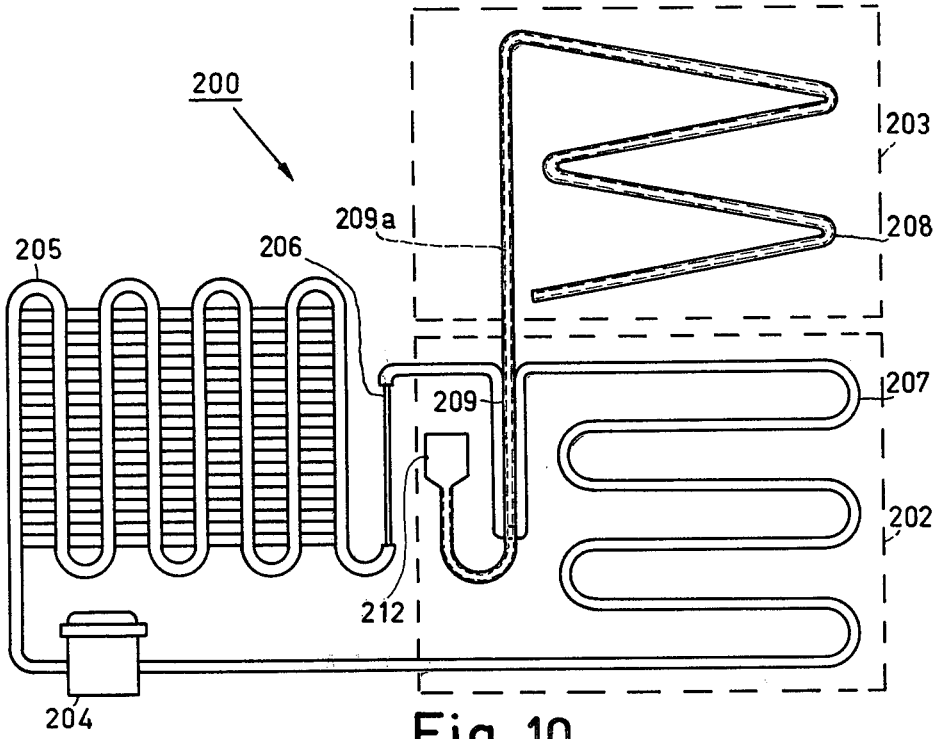
Figure 11:
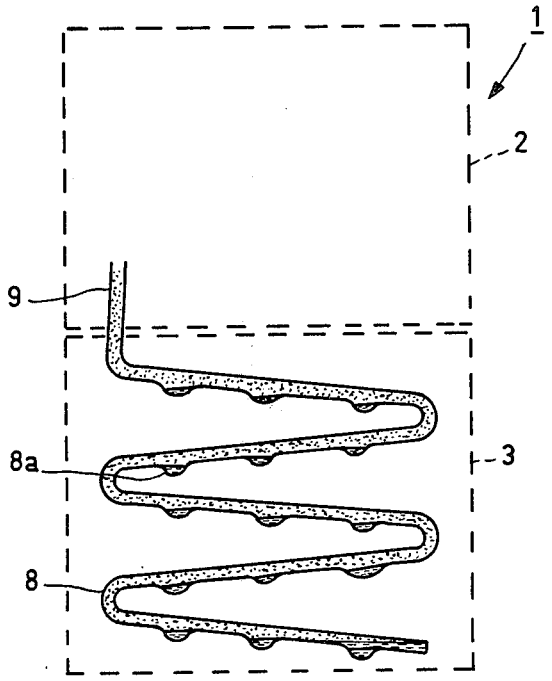

FIG. 6 shows a variant of the secondary condensor of the refrigerator of FIG. 1, FIG. 7 is a cross-sectional view taken on the line VII—VII of FIG. 6, FIG. 8 schematically represents two refrigerating systems in a refrigerator in which the freezing compartment is disposed underneath the refrigerating compartment, FIG. 9 shows the construction of FIG. 8, in which the secondary condensor is curved, FIG. 10 shows the construction of FIG. 8 in which the secondary refrigerating system now includes a capillary structure, and FIG. 11 shows another example of the secondary evaporator.

In FIG. 1 the reference numeral 1 refers to a refrigerator, which comprises a freezing compartment 2 and a refrigerating compartment 3. In this case the freezing compartment 2 is disposed above the refrigerating compartment 3.

The refrigerating compartment 2 is cooled by means of a primary refrigerating system which comprises a compressor 4, a primary condensor 5, a capillary tube 6 serving as a restriction, and a primary evaporator 7. The primary refrigerating system contains a normal refrigerant, such as freon. The temperature in the refrigerating compartment 2 is thermostatically controlled and the temperature level is adjustable in known manner, not indicated.

The refrigerating compartment 3 is cooled by means of a secondary refrigerating system, whose secondary evaporator 8 is located in the refrigerating compartment 3 and whose secondary condensor 9 is located in an insulted outer wall of the freezing compartment 2. The secondary condensor 9 has a condensation wall 10, which is brought into thermally conducting contact with the primary evaporator 7. The secondary refrigerating system also contains a normal refrigerant, such as freon. The secondary evaporator 8 and the secondary condensor 9 are constituted by a single pipe. Heat transfer in the secondary refrigerating system is effected in that the liquid refrigerant evaporates in the evaporator 8 and subsequently condenses on the surface of the condensation wall 10. The condensed refrigerant flows back into the secondary evaporator 8 as a result of the force of gravity and in this way cools the refrigerating compartment 3.

The temperature in the refrigerating compartment 3 is controlled by varying the available condensation wall area 10. For this purpose, the end 11 of the secondary condensor 9 terminates in a reservoir 12, which is filled with a control gas 13. This control gas 13 constitutes an interface 15 with the refrigerant vapour 14 at the location of the condensation wall 10. Below this interface 15 condensation of refrigerant vapour takes place during operation, whilst above the interface no condensation takes place. The position of the interface 15 determines the size of the available condensation wall area, hence the amount of refrigerant which condenses and thus also the temperature of the secondary evaporator 6.

The interface 15 can be moved along the condensation wall 10 by varying the amount of control gas 13. For this purpose, a reversible control-gas getter 16, which can be heated, is contained in the reservoir 12. At increasing temperature the control gas getter releases more control gas and moves the interface 15 downwards, so that the available surface area of the condensation wall 10 is reduced. Conversely the control gas getter will absorb more control gas at decreasing temperature, so that the interface 15 is moved upwards and the available condensation wall area increases. As refrigerant, for example freon R12 ($CF_2Cl_2$) is used as control gas nitrogen, and as control gas getter the well-known molecular filter material, zeolite type 4A. This type of zeolite getters nitrogen, but substantially no freon R12. Of course, other combinations are also possible.

Figure 2:
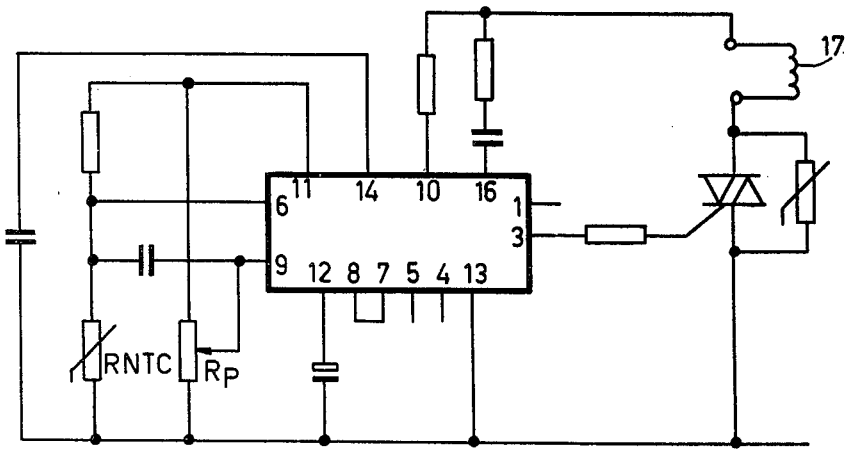

The control-gas getter 16 may be heated with the aid of a heating element 17, which is included in the electrical control circuit in accordance with FIG. 2. This known control circuit is described in the brochure "Design of time-proportional temperature controls using the TDA 1023" (Philips Elcoma Division, Technical Information No. 025, 1 Mar. 1977). The integrated circuit TDA 1023 in this control circuit is a time-proportional control circuit. The temperature-sensitive element $R_{NTC}$ is located in the refrigerating compartment 3.

The operation of the refrigerating system will now be described in more detail with reference to an example.

Assume that the temperature in the freezing compartment 2 is −18° C. and the temperature in the refrigerating compartment 3 is +4° C. Food is to be frozen rapidly and the temperature level in the freezing compartment 2 is set to −30° C. As a result of this, the primary evaporator 7 becomes colder and consequently more vapour will condense in the secondary condensor 9. As a result of this, the temperature in the refrigerating compartment 3 decreases. This is detected by the temperature-sensitive element $R_{NTC}$ in the refrigerating compartment 3. Via the electrical control circuit the heating element 17 is now switched on. The control gas getter 16 is heated and starts to release control gas 13. As a result of this, the interface 15 moves downwards along the condensation wall 10. The size of the available condensation wall area is reduced and less refrigerant vapour will condense. This compensates for the afore mentioned effect that more vapour starts to condense because the primary evaporator 7 has become colder.

The temperature in the refrigerating compartment 3 is consequently maintained at the level of approximately +4° C. When the temperature in the freezing compartment is reset to −18° C. the process is reversed.

Thus, the invention enables the temperature in the refrigerating compartment 3 to be maintained constant automatically, irrespectively of the temperature in the freezing compartment 2. Moreover, it is possible to set the temperature level in the refrigerator compartment 3 manually to a desired value via the variable resistor $R_p$, which is included in the electrical control circuit, which obviously is attended by a displacement of the interface 15.

Defrosting of the secondary evaporator 8 is possible periodically via a timing circuit or counter circuit to be included in the electrical control circuit. When the temperature of the secondary evaporator 8 is above −2° C. no ice will be formed on the secondary evaporator. This high evaporator temperature may be used, because of the continuous heat transfer in the secondary refrigerating system.

Figure 3:
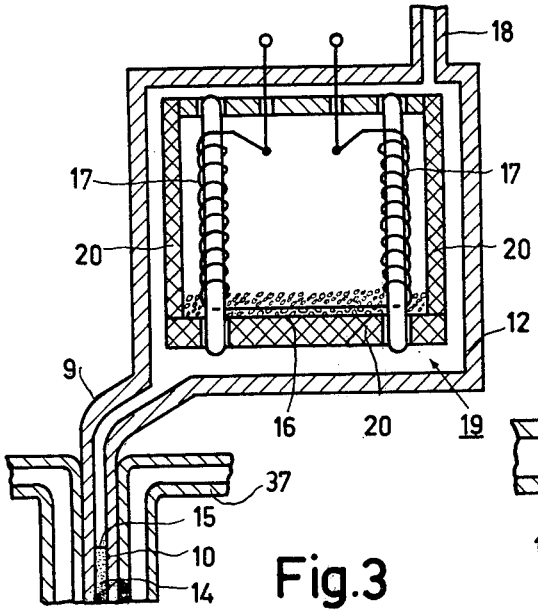
FIG. 3 shows a cross-section of a control-gas reservoir, which forms part of the refrigerator of FIG. 1.

A preferred form of the reservoir 12 containing the control gas is shown in FIG. 3. The reservoir has a filling opening 18 for the refrigerant and the control gas. In the reservoir 12 a holder 19 is located, which contains the control gas getter 16 and the heating element 17. The walls 20 of the holder 19 are porous, so as to allow the control gas to pass through and they are thick-walled so as to insure a satisfactory thermal insulation. Preferably, the reservoir 12 is disposed in the thermally insulated outer wall of the refrigerator cabinet, the filling opening 18 being disposed at the outside. This enables the secondary refrigerating system to be filled during one of the last manufacturing stages.

Figure 4:
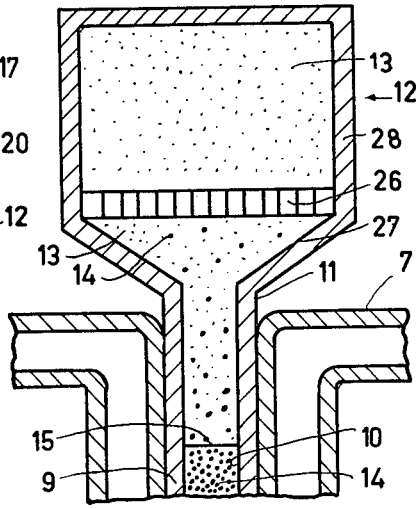
FIG. 4 shows an other example of the control-gas reservoir.

FIG. 4 shows a different example of a control-gas reservoir. The reservoir 12 is divided into two sections 27 and 28 by a partition 26. This partition is permeable to the control gas 13, but not to the refrigerant vapour 14. Thus, no refrigerant vapour can enter the section 28 of the reservoir. Temperature control of the refrigerating compartment 3 is effected automatically. When the temperature in the refrigerating compartment 3 rises, more refrigerant will evaporate and the vapour pressure will increase. The control gas is further pressurised and the interface 15 moves upwards, so that the available condensation wall area increases and a new vapour pressure equilibrium is established. More vapour will condense and the temperature rise will be eliminated substantially.

As the operating temperature of the secondary evaporator 8 depends on the vapour pressure, filling the reservoir 12 with control gas 13 should be effected accurately. Obviously, the vapour pressure also depends on the temperature of the primary evaporator 7. When the temperature of the freezing compartment 2 is set to freezing-in, the temperature of the primary evaporator 7 decreases, so that more refrigerant vapour condenses in the secondary condensor 9 and the temperature in the refrigerating compartment 3 decreases. The lower temperature of the primary evaporator 7 also results in a reduced vapour pressure in the secondary condensor 9, so that more control gas 13 is withdrawn from the section 28 of the reservoir 12 and the interface 15 moves downwards along the condensation wall 10. The available condensation wall area is reduced and the temperature drop is substantially compensated for.

However, in the present example changing the temperature level of the refrigerating compartment 3 is not possible. If the section 28 of the reservoir 12 also contains a reversible control gas getter, which can be heated by a heating element which is included in an electrical control circuit, which circuit includes a temperature-sensitive element accommodated in the refrigerating compartment 3 for controlling the heating element, changing the temperature level in the refrigerating compartment is possible.

Figure 5:
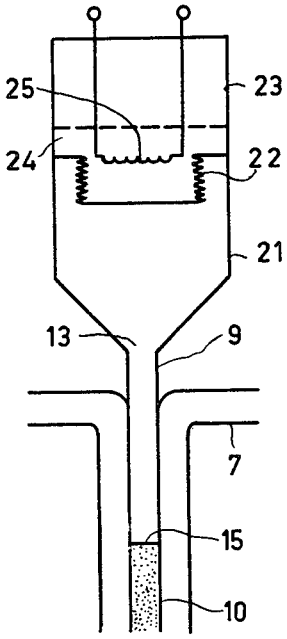
FIG. 5 shows still another example of the control-gas reservoir.

FIG. 5 shows still an other construction for moving the interface 15. In accordance with this construction, in which corresponding parts are designated by the same reference numerals as in FIG. 1, the secondary condensor 9 terminates in a reservoir 21, in which a movable bounding wall, such a diaphragm or bellows 22 are located. A displacement of the bellows 22 results in the displacement of the interface 15 and thus a change in size of the available condensation wall area 10. For automatic control of the refrigerating-compartment temperature the displacement of the bellows 22 should be related to the difference between the desired and the prevailing temperature in the refrigerating compartment. This can be achieved in different manners. In the present case this is effected by mounting a pressure-transfer medium 24 and a heating element 25 in a space 23 above the bellows 22. The heating element 25 may then again be included in an electrical control circuit as shown in FIG. 2. As pressure transfer medium it is for example possible to use a medium, which in the same as the refrigerant. When the heating element 25 is switched on, the vapour pressure increases and the bellows 22 are urged downwards, which in their turn force the control gas 13 in the secondary condensor 9 downwards. The interface 15 is then also moved downwards accordingly.

The bellows 22 can be controlled with the aid of various control systems such as an on-off control system (for example, a bimetallic strip), an analog or a digital control system (for example, a servo system).

FIG. 6 shows a variant of the secondary condensor of FIG. 1. In this case the secondary condensor 9 takes the form of a tapered tube whose cross-section increases towards the secondary evaporator 8. Owing to the comparatively large cross-section at the entrance side of the condensor tube 9 the vapour speed upon entrance in the condensor tube is low. As a result of this, the condensed refrigerant can readily flow back to the secondary evaporator 8. Another advantage of the tapered condensor tube 9 is that the upper portion of the tube has a smaller volume, so that for control actions over this portion the control speed is high.

FIG. 7 is a cross-sectional view of the secondary condensor tube 9 and the primary evaporator tube 7 which is in heat exchanging contact therewith. The primary evaporator tube 7 is disposed on both sides of the secondary condensor tube 9. As a result of this the condensation wall is twice as large. The condensor tube 9 and the evaporator tube 7 have a slightly flattened shape, so that in comparison with for example round tubes, the volume of the control gas is low and the surface area of the condensation wall 10 is large. When a control-gas getter is employed, the amount of getter material can then also be small. This moreover reduces the electric power required for the temperature control of the control-gas getter.

In the refrigerator of FIG. 1, the freezing compartment is disposed above the refrigerant compartment. Thus, it can be ensured by means of a simple construction of the refrigerating system that the condensed refrigerant flows back to the secondary evaporator by the force of gravity. FIG. 8, in which corresponding parts bear the same reference numberals as in FIG. 1, but augmented by the number 100, schematically shows a refrigerator in which the refrigerating compartment 103 is disposed above the freezing compartment 102. The secondary condensor 109 is located in an insulated outer wall of the refrigerating compartment 103, where it is in heat-exchanging contact with the primary evaporator 107. The refrigerant, which has condensed in the secondary condensor 109, also flows back to the secondary evaporator 108 by the force of gravity.

In the refrigerator construction in accordance with FIG. 8 the entire secondary refrigerating system is located at the same level as the refrigerating compartment 103, which demands a substantial mounting height of the refrigerating compartment. This substantial mounting height can be reduced by construction as shown in FIG. 9. The secondary condensor 109*a* and the part of the primary evaporator 107*a*, which is in heat exchanging contact therewith, are curved. The length of the secondary condensor 109*a* and thus the size of the condensation wall area is now equal to that in FIG. 8, whilst the mounting height of the refrigerating compartment and thus the overall height of the refrigerator is smaller.

An other construction, where the refrigerating compartment also disposed above the freezing compartment, is shown in FIG. 10. The parts corresponding in FIG. 1 now bear the same reference numerals, augmented by the number 200. The secondary condensor 209 is located in an insulated wall of the freezing compartment 202 and the secondary evaporator 209 in the refrigerating compartment 203. The secondary evaporator 208 is thus located above the secondary condensor 209. In order to feed the condensed refrigerant back from the condensor 209 to the evaporator 208 a capillary structure 209 is located in the secondary condensor 209 and in the secondary evaporator 208, for example a layer of metal gauze or capillary grooves in the inner wall.

It will be obvious that any arbitrary construction of a refrigerator with a refrigerating compartment and a freezing compartment utilizing the invention, is possible.

FIG. 11 shows a favourable construction of a secondary evaporator 8 of the refrigerator of FIG. 1. The secondary evaporator 8 is locally provided with pockets 8*a*, which serves as reservoirs for liquid refrigerant. Thus, a uniform evaporation of the liquid is obtained over the entire evaporation area. Moreover, the cooling time for the refrigerating compartment, for example after a defrosting period, is short, because the vapour enters the secondary condensor 9 directly saturated.

Obviously, it is also possible to vary the wall area available for condensation by the use of for example a folding condensation wall, or by covering the condensation wall by mechanical means, for example a plunger.

Instead of a refrigerator with a primary refrigerating system consisting of a compressor, a condensor and an evaporator is alternatively possible to provide the refrigerator with a primary refrigerating system based on absorption.

We claim:

1. A refrigerator comprising a freezing compartment; a refrigerating compartment; a primary refrigerating system containing a primary refrigerant and including a primary evaporator disposed in the freezing compartment; a secondary refrigerating system containing a secondary refrigerant and a control gas and including a secondary evaporator disposed in the refrigerating compartment and a secondary condensor disposed in the freezing compartment in direct heat-exchange contact with the primary evaporator, at least part of the inner wall of said secondary condensor forming a condensation surface whereon secondary refrigerant vapour condenses during operation, said secondary refrigerating system being constituted as a tube closed off at the outer end of the secondary evaporator portion thereof; a reservoir containing a reversible control-gas getter and being connected to the outer end of the secondary condensor portion of the secondary refrigerating system tube, the control gas forming an interface with the secondary refrigerant vapour at the location of the condensation surface; and means for heating said getter to generate free control gas so as to shift the position of the interface with respect to the condensation surface and thus vary the effective condensation surface area to thereby control the temperature of said secondary evaporator portion.

2. A refrigerator according to claim 1, in which said heating means comprises an electric heating element included in an electrical control circuit, said control circuit including a temperature-sensitive element mounted in the refrigerating compartment to control the electric heating element and thereby to maintain a specific temperature level in the refrigerating compartment.

3. A refrigerator according to claim 2, in which the reversible control-gas getter and the electric heating elment are accommodated in a holder formed of a thermal insulating material, said holder having at least one wall permeable to the control gas.

4. A refrigerator according to claim 1, 2 or 3, in which the secondary refrigerant is a Freon, the control gas is nitrogen, and the reversible control-gas getter is a molecular filter material.

5. A refrigerator according to claim 1, in which the secondary condensor portion is tapered and has a cross section increasing in the direction of the secondary evaporator portion.

6. A refrigerator according to claim 1, in which the secondary condensor portion and the secondary evaporator portion are provided with a capillary structure for feeding back condensed secondary refrigerant to the secondary evaporator portion.

7. A refrigerator according to claim 1, in which the secondary evaporator portion is provided with one or more pockets serving as reservoirs for liquid secondary refrigerant.

* * * * *